US005343792A

United States Patent [19]

Liao

[11] Patent Number: 5,343,792

[45] Date of Patent: Sep. 6, 1994

[54] BEATER AMPLITUDE ADJUSTMENT DEVICE FOR THE BASE DRUM PEDAL MECHANISM OF A BASE DRUM

[75] Inventor: Tsun-Chi Liao, Taichung, Taiwan

[73] Assignee: Hwa Shin Musical Instrument Co., Ltd., Taichung, Taiwan

[21] Appl. No.: 120,513

[22] Filed: Sep. 14, 1993

[51] Int. Cl.[5] ..... G10D 13/02

[52] U.S. Cl. ..... 84/422.1

[58] Field of Search ..... 84/422.1

[56] References Cited

U.S. PATENT DOCUMENTS

| | | | |
|---|---|---|---|
| 3,930,431 | 1/1976 | Magadini | 84/422.1 |
| 4,819,536 | 4/1989 | Lombardi | 84/422.1 |
| 5,297,467 | 3/1994 | Hoshino | 84/422.1 |

*Primary Examiner*—Michael L. Gellner
*Assistant Examiner*—Patrick J. Stanzione
*Attorney, Agent, or Firm*—Bacon & Thomas

[57] ABSTRACT

A base drum beater amplitude adjustment device comprised of a beater holder mounted around the revolving shaft of the pedal mechanism of a base drum to hold a beater, and a locating device made of a split cylinder and fastened around the revolving shaft to retain the beater holder in position, the beater holder consisted of two opposing parts connected together around the locating device by screw bolts, whereby the angular position of the beater is adjusted by loosening the screw bolts, then turning the beater holder to the desired angular position around the locating device, and then fastening tight the screw bolts again.

1 Claim, 4 Drawing Sheets

BEATER AMPLITUDE ADJUSTMENT DEVICE FOR THE BASE DRUM PEDAL MECHANISM OF A BASE DRUM

BACKGROUND OF THE INVENTION

The present invention relates to a base drum pedal mechanism adjustment device for adjusting the amplitude of the beater of the pedal mechanism of a base drum.

The pedal mechanism of a base drum as shown in FIG. 1, is generally comprised of two upright supports upstanding from a base frame to hold a revolving shaft in a horizontal position by bearings, a flywheel mounted around the revolving shaft, a pedal having one end hinged to the base frame and an opposite end connected to the flywheel by a chain, a beater holder fixed to the flywheel to hold a beater by a screw. As the pedal is pressed by the foot, the chain is pulled downward to turn the flywheel, causing the beater to hit the drum. The amplitude of the beater is controlled by a cam mechanism. The cam mechanism is comprised of an inner can fixed to the revolving shaft, an outer cam engaged with the inner can and coupled with a hanging ring, a spring having a top end suspended from the hanging ring and a bottom end fastened to a locating member at an outer side by one upright support. The spring is provided to return the beater and the pedal back to their former positions after each strike. The procedure to adjust the amplitude of the beater is done by loosening the cam mechanism, then turning the revolving shaft to change the angular position of the beater holder. When adjusted, the cam mechanism is fastened tight again. As the angular position of the beater holder is adjusted, the elevation of the free end of the pedal is relatively adjusted. When the free end of the pedal is lifted higher, more effort should be relatively employed to the pedal to pull the chain and turn the flywheel, rendering the player troubled. Due to the limitation of the chain, the adjustable range of the amplitude of the beater is limited, and therefore the quality of the drum cannot be fully carried out.

SUMMARY OF THE INVENTION

The present invention has been accomplished under the aforesaid circumstances. It is therefore the principal object of the present invention to provide a beater amplitude adjustment device which can be adjusted to change the angular position of the beater of the pedal mechanism of a base drum without changing the elevation of the pedal. It is another object of the present invention to provide a beater amplitude adjustment device for a base drum which is easy to adjust.

The aforesaid objects are achieved by making the beater holder into two opposing parts fastened together around the revolving shaft of the pedal mechanism of the base drum by screw bolts, and providing a locating device made of a split cylinder fastened within the beater holder around the revolving shaft to prohibit relative movement between the beater holder and the revolving shaft. The angular position of the bear is adjusted simply by loosening the screw bolts then turning the beater holder around the locating device and then tightening up the screw bolts again.

DETAILED DESCRIPTION OF THE PREFERRED EMBODIMENT

Figure 1:
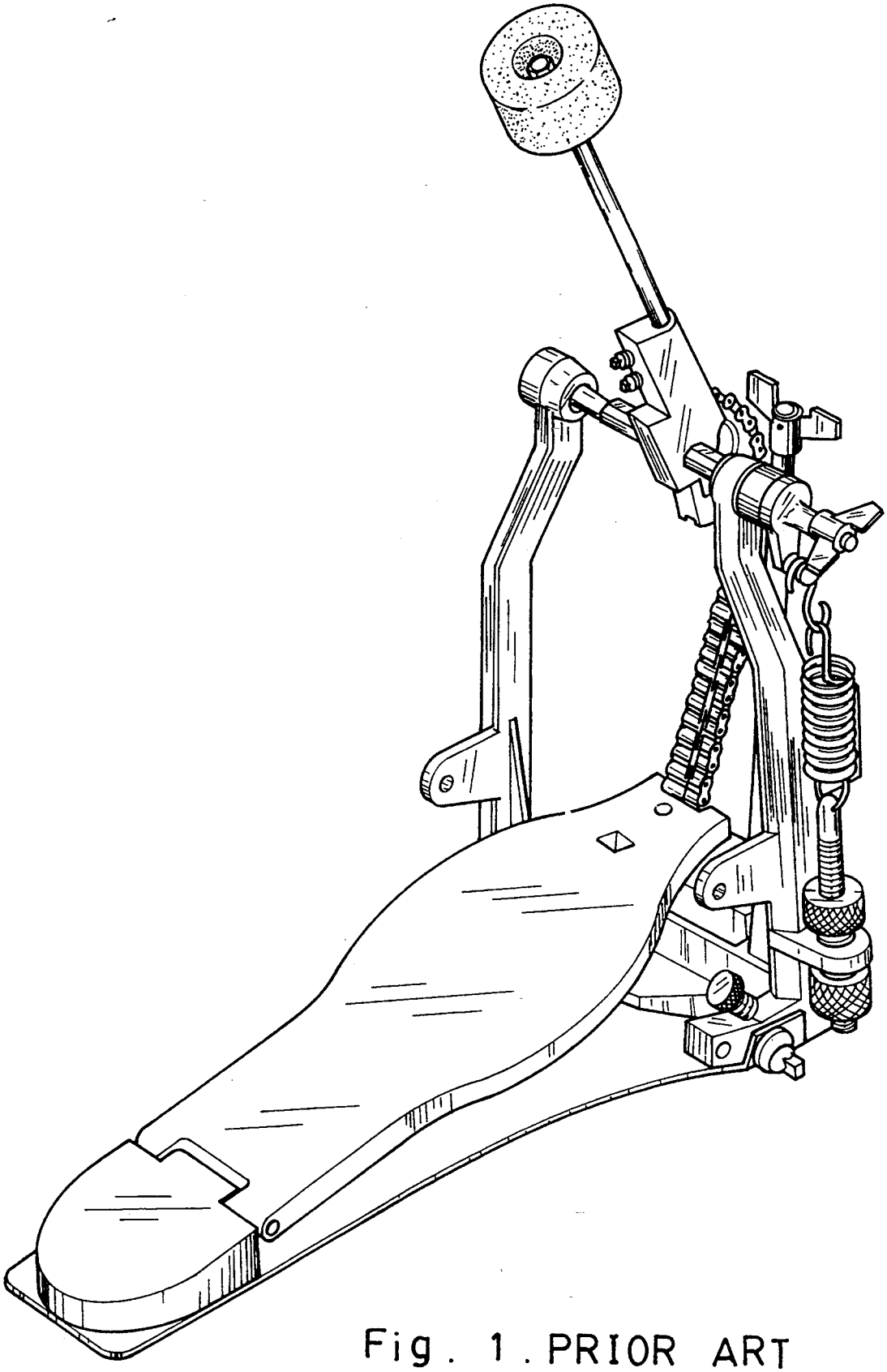
Fig. 1. PRIOR ART
FIG. 1 is an elevational view of a base drum pedal mechanism according to the prior art.
Figure 2:
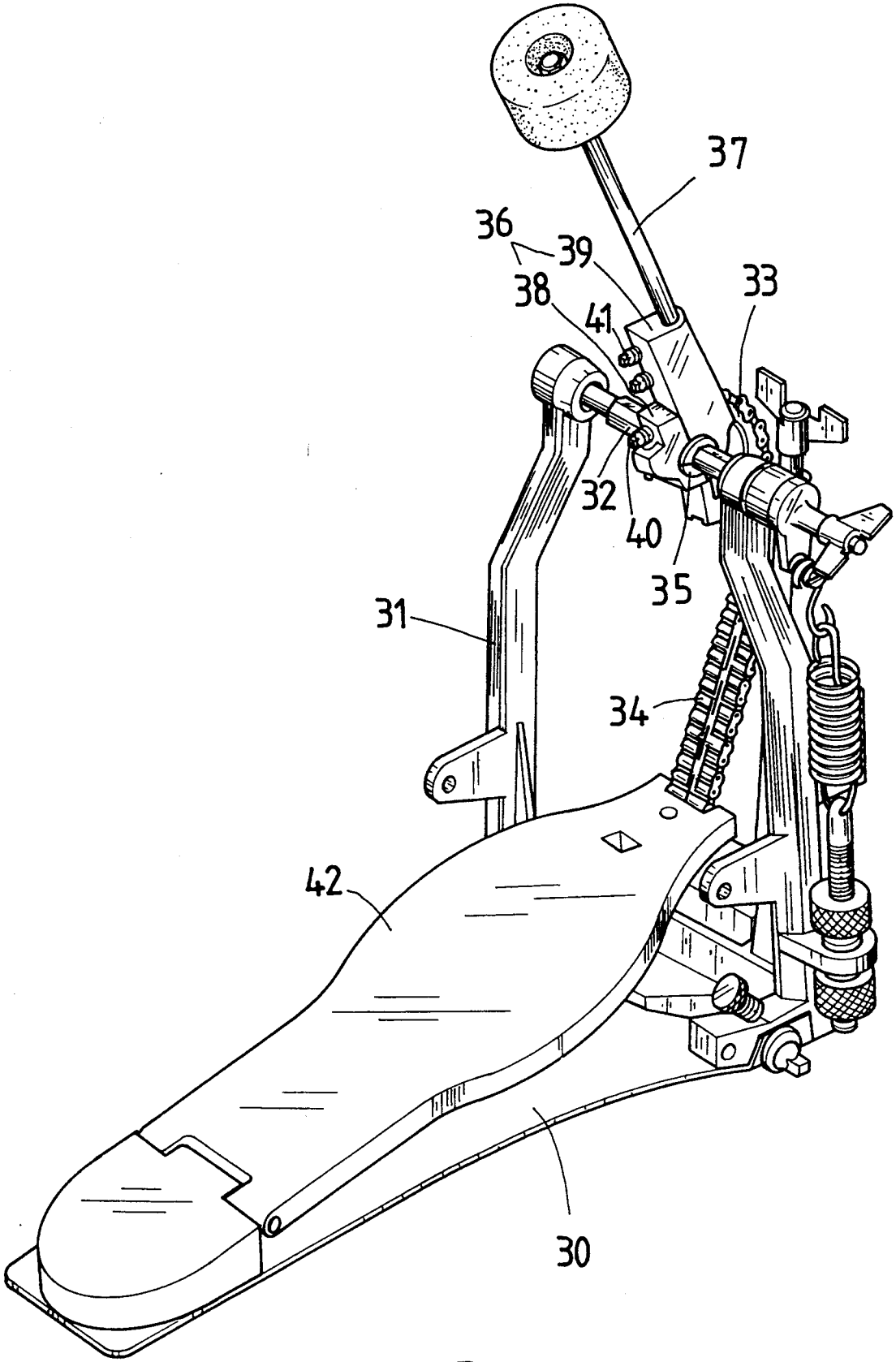
FIG. 2 is an elevation view of a base drum pedal mechanism installed with a beater amplitude adjustment device according to the present invention.
Figure 3:
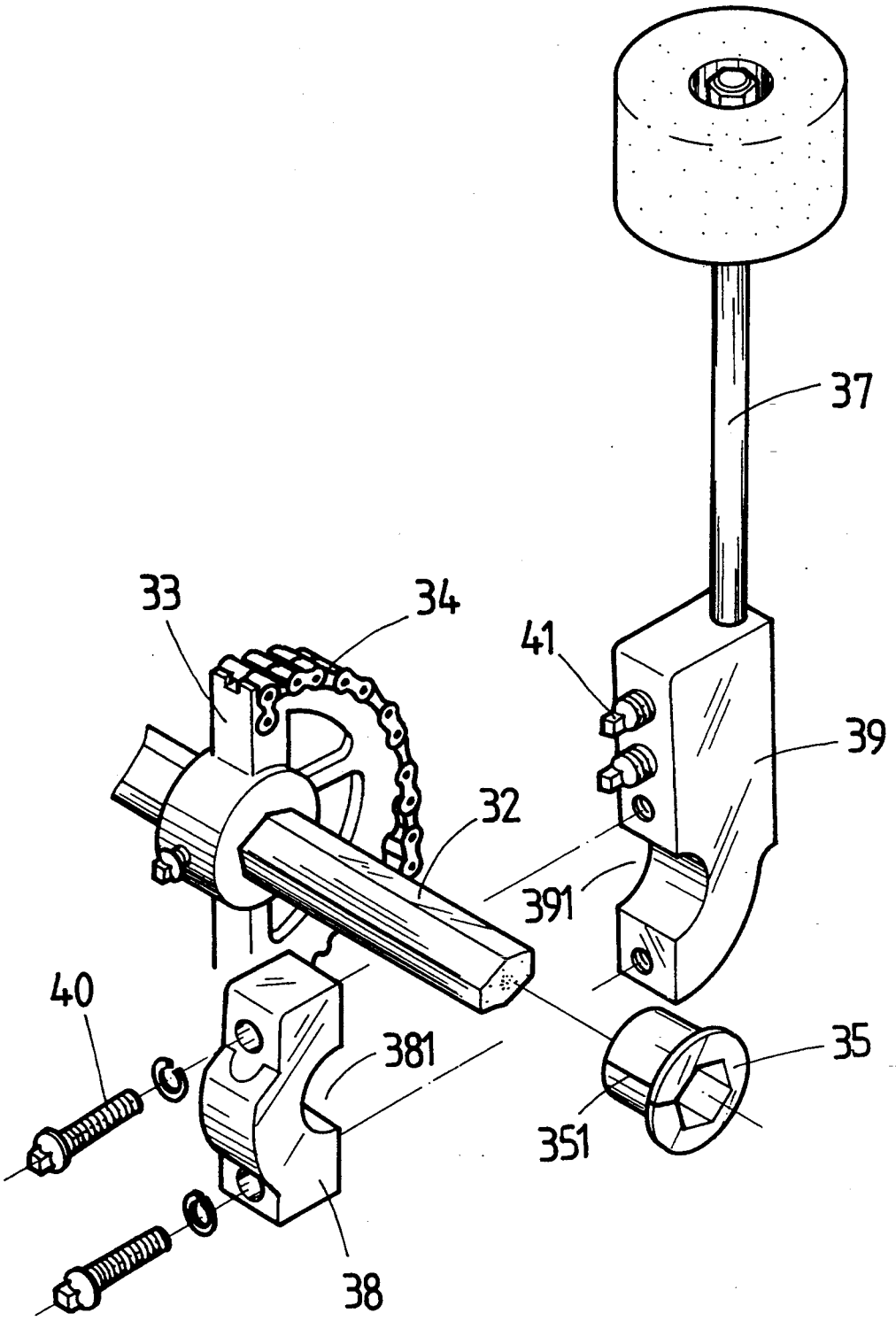
FIG. 3 is an exploded view of the beater amplitude adjustment device shown in FIG. 2.

Referring to FIGS. 2 and 3, a base drum pedal mechanism is shown comprised of a base frame 30, two upright supports 31 raised from the front end of the base frame 30 at two opposite sides, a revolving shaft 32 transversely supported between the upright supports 31, a flywheel 33 mounted around the revolving shaft 32, a pedal 42 having one end hinged to the base frame 30 and an opposite end connected to the flywheel 33 by a chain 34, a beater holder 36 fastened to the revolving shaft 32, a locating device 35 mounted around the revolving shaft 32 to retain the beater holder 36 in position, and a beater 37 mounted on the beater holder 39. The revolving shaft 32 has a uniform, polygonal cross section. The locating device 35 is made from a split cylinder fitted around the periphery of the revolving shaft 32, having a split 351 through its length. Because of the effect of the spilt 351, the diameter of the locating device 35 can be adjusted within a certain range. The beater holder 36 is comprised of two opposing parts, namely, the mounting block 38 and the beater carrier block 39 connected together around the revolving shaft 32 by screw bolts 40. The beater 37 is inserted into a holder (not shown) on the beater carrier block 39 and secured in place by tightening up screws 41. The mounting block 38 has a half-round recess 381. The beater carrier block 39 has a half-round recess 381 on the mounting block 38. As the mounting block 38 and the beater carrier block 39 are connected together, the half-round recesses 381;391 are linked and formed into a round hole, which receives the locating device 35 and the revolving shaft 32. As the screw bolts 40 are fastened tight, the beater holder 36 becomes firmly retained to the locating device 35 and the revolving shaft 32 in position. As the leg stepped on the pedal 42 to pull the chain 34, the flywheel 33 is turned clockwise, and the revolving shaft 32 is synchronously carried to turn the beater holder 36, causing the beater 37 to strike the base drum (not shown).

Figure 4:
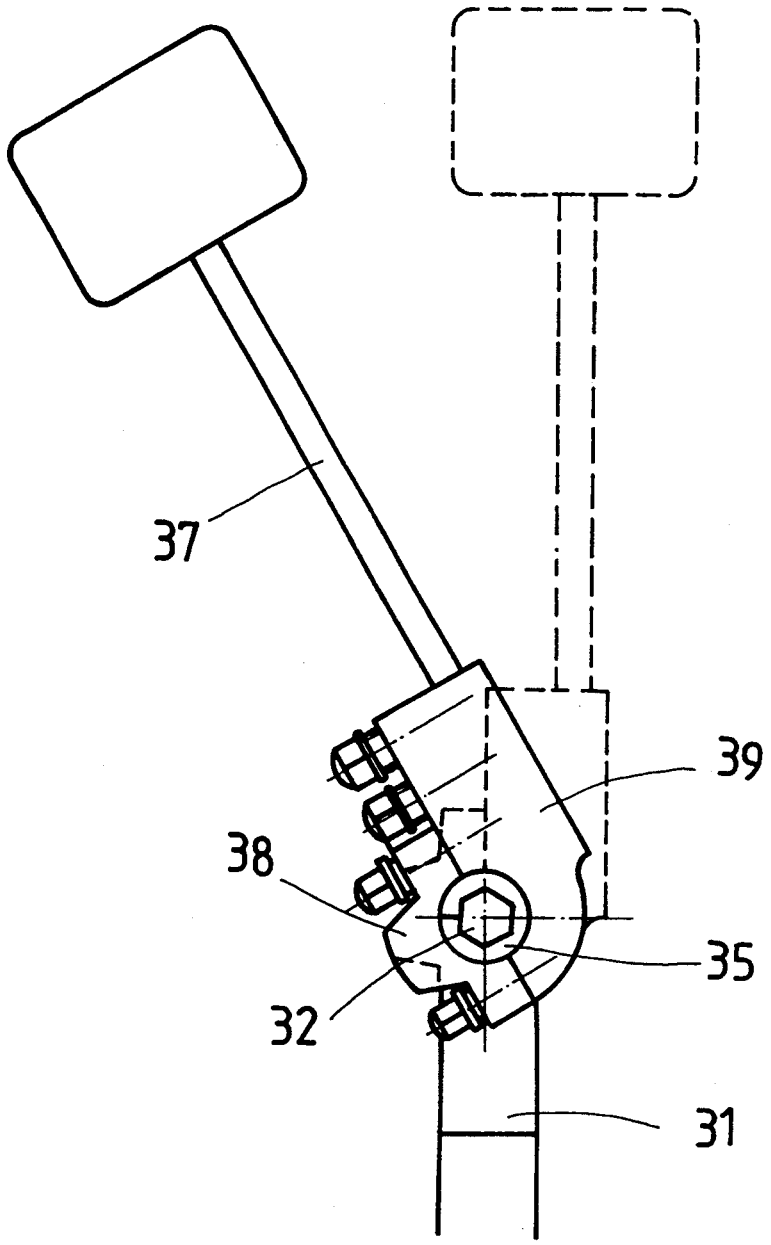
FIG. 4 is a schematic drawing showing the beater amplitude adjustment device of FIG. 2 adjusted.

Referring to FIG. 4, the angular position of the beater 37 can be adjusted by loosening the screw bolts 40 for permitting the beater holder 36 to be turned relative to the locating device 35. When adjusted, the screw bolts 40 are fastened tight again, and therefore the beater holder 36 is retained to the locating device 35 and the revolving shaft 32 at the adjusted angular position. As the beater holder 36 is adjusted relative to the revolving shaft 32, adjusting the angular position of the beater holder 36 (namely, the beater 37) does not change the elevation of the free end of the pedal 42. Furthermore, the aforesaid arrangement allows the beater 37 to be adjusted within 45× angle.

While only one embodiment of the present invention has been shown and described, it will be understood that various modifications and changes could be made without departing from the spirit and scope of the invention.

I claim:

1. A base drum beater amplitude adjustment device comprising: a revolving shaft supported between two upright supports on the base frame of a pedal mechanism of a base drum; a beater holder mounted around said revolving shaft to hold a beater; and a locating device fastened between said beater holder and said revolving shaft to prevent relative movement between said revolving shaft and said beater holder, said revolving shaft having a polygonal cross section, said locating device being made from a split cylinder having an inner diameter fitting around said polygonal cross section of said revolving shaft and a longitudinal split through the length, said beater holder being comprised of two opposing parts connected together by screw bolts, each part of said beater holder having a respective half-round recess linked to each other and respectively fitted over said locating device.

* * * * *